US006056335A

United States Patent [19]

Dietrich

[11] Patent Number: 6,056,335

[45] Date of Patent: May 2, 2000

[54] LOCK BUTTON CLIP ASSEMBLY

[75] Inventor: Robert G. Dietrich, Pinckney, Mich.

[73] Assignee: Magna Interior Systems Inc., Ontario, Canada

[21] Appl. No.: 09/207,669

[22] Filed: Dec. 9, 1998

Related U.S. Application Data

[60] Provisional application No. 60/069,105, Dec. 9, 1997.

[51] Int. Cl.[7] ..... E05B 3/00

[52] U.S. Cl. ..... 292/353; 292/348; 292/347; 292/DIG. 53

[58] Field of Search ..... 411/527, 520, 411/437, 433; 292/353–348, DIG. 53, 347

[56] References Cited

U.S. PATENT DOCUMENTS

| | | | |
|---|---|---|---|
| 2,180,929 | 11/1939 | Murphy . | |
| 2,211,728 | 8/1940 | MacFadden | 411/520 X |
| 2,242,591 | 5/1941 | Murphy . | |
| 2,293,615 | 8/1942 | Murphy . | |
| 2,737,269 | 3/1956 | Flora | 411/527 X |
| 2,834,628 | 5/1958 | Paparelli et al. | 292/347 |
| 2,950,614 | 8/1960 | Evans | 292/347 |
| 3,372,950 | 3/1968 | Wind . | |
| 3,408,836 | 11/1968 | Trammell, Jr. . | |
| 3,838,876 | 10/1974 | Haven . | |
| 4,238,133 | 12/1980 | Trammell, Jr. | 292/347 |
| 4,415,192 | 11/1983 | Kodama et al. . | |
| 4,610,588 | 9/1986 | Van Buren, Jr. et al. | 411/527 X |
| 4,842,312 | 6/1989 | Iwasaki et al. | 292/347 X |
| 5,088,781 | 2/1992 | Ono et al. . | |

FOREIGN PATENT DOCUMENTS

| | | |
|---|---|---|
| 0 198 210 | 10/1986 | European Pat. Off. . |
| 0 607 713 | 7/1994 | European Pat. Off. . |
| 2 492 875 | 4/1982 | France . |
| 2 090 318 | 7/1982 | United Kingdom . |

*Primary Examiner*—Teri Pham
*Attorney, Agent, or Firm*—Pillsbury Madison & Sutro LLP

[57] ABSTRACT

The present invention relates to a lock button assembly for installation on a threaded actuating member operatively connected to a vehicle door locking mechanism. The assembly has a manually engageable lock button having a longitudinally extending bore. The bore is configured to receive a threaded end portion of the actuating member. The lock button has an opening on one side thereof providing access to the bore. A clip member is mounted exteriorly to the lock button. The clip member has a resilient projection extending inwardly through the opening and into the bore for frictional engagement with the threaded portion. The projection is biased to permit ingress of the actuating member into the bore and to prevent egress of the actuating member from the bore. The present invention also relates to a method for installing a lock button assembly on a threaded actuating member operatively connected to a vehicle door locking mechanism.

11 Claims, 12 Drawing Sheets

LOCK BUTTON CLIP ASSEMBLY

This application claims the benefit of U.S. Provisional Application No. 60/069,105, filed Dec. 9, 1997.

FIELD OF INVENTION

The present invention relates to a lock button assembly for installation on a threaded actuating member operatively connected to a vehicle door locking mechanism. The present invention also relates to a method for installing a lock button assembly on a threaded actuating member operatively connected to a vehicle door locking mechanism.

BACKGROUND OF INVENTION

Lock buttons are commonly used to actuate the locking mechanisms of automobile doors. Conventionally, these lock buttons have two constructions: round buttons and square or rectangular buttons. Typically, in both constructions, the button is spun onto a threaded rod which is operatively connected to the locking mechanism of the door.

Round lock buttons may be spun onto the threaded rod after all other trim components are mounted in place on the automobile door. Usually, spinning the round lock buttons requires special equipment. Alternatively, the round buttons may be spun on manually, but this method tends to cause the installer to develop physical problems related to repetitive twisting motions.

Rectangular and square lock buttons have the same disadvantages as round buttons. Additionally, the rectangular or square lock buttons must be assembled before the trim components are mounted in place on the automobile door. Otherwise, the rotation of a rectangular or square button would necessitate an enlarged circular hole to be formed in the trim components to allow rotation of the button. Because the rectangular or square lock buttons must be assembled before the trim components are mounted in place, the trim components must be guided over the lock button, thereby increasing the difficulty in assembling the automobile door.

SUMMARY OF THE INVENTION

Accordingly, it is an object of the present invention to provide a lock button assembly which obviates the problems associated with conventional lock buttons. In order to achieve this objective, there is provided a lock button assembly for installation on a threaded actuating member operatively connected to a vehicle door locking mechanism. The assembly has a manually engageable lock button having a longitudinally extending bore. The bore is configured to receive a threaded end portion of the actuating member. The lock button has an opening on one side thereof providing access to the bore. A clip member is mounted exteriorly to the lock button. The clip member has a resilient projection extending inwardly through the opening.

The lock button according to the present invention offers a number of advantages. The lock button assembly can be installed after all other components have been installed on the door. Also, no twisting motions or mechanized tools are necessary to install the lock button assembly. Finally, the cost of the production and installation of the lock button assembly according to the present invention will be lower in comparison to conventional lock buttons.

Preferably, the exterior structure is a clip member with opposing side walls mounted exteriorly of the button and the projection is formed integrally with one of the side walls.

The clip member may have an outwardly extending projection opposing the inwardly extending projection with the outwardly extending projection being positioned and configured to be moved in a releasing direction so as to move said inwardly extending projection out of engagement with the upper end portion threads, thereby enabling said lock button assembly to be moved upwardly with respect to the actuating member. With this preferred arrangement, the lock button assembly may be pushed down to a desired height and then subsequently adjusted with the use of a release tool. The release tool may also be used to release the lock button assembly and allow removal of a lock button therefrom.

Another aspect of the present invention relates to a method for installing a lock button assembly on a threaded actuating member operatively connected to a vehicle door locking mechanism. The method comprises providing a lock button assembly comprising a manually engageable lock button having a longitudinally extending bore. The bore is configured to receive a threaded end portion of the actuating member. The lock button has an opening on one side thereof providing access to the bore. A clip member is mounted exteriorly to the lock button. The clip member has a resilient projection extending inwardly through the opening and into the bore for frictional engagement with the threaded portion. The projection is biased to permit ingress of the actuating member into the bore and to prevent egress of the actuating member from. The lock button assembly is initially positioned on the actuating member with the end portion received in the bore. The assembly is moved along the actuating member until the assembly reaches an installed position. A tool is positioned to move a release projection out of engagement with the upper end portion threads, thereby enabling the lock button assembly to be freely moved along the actuating member.

DETAILED DESCRIPTION OF THE INVENTION

Figure 1:
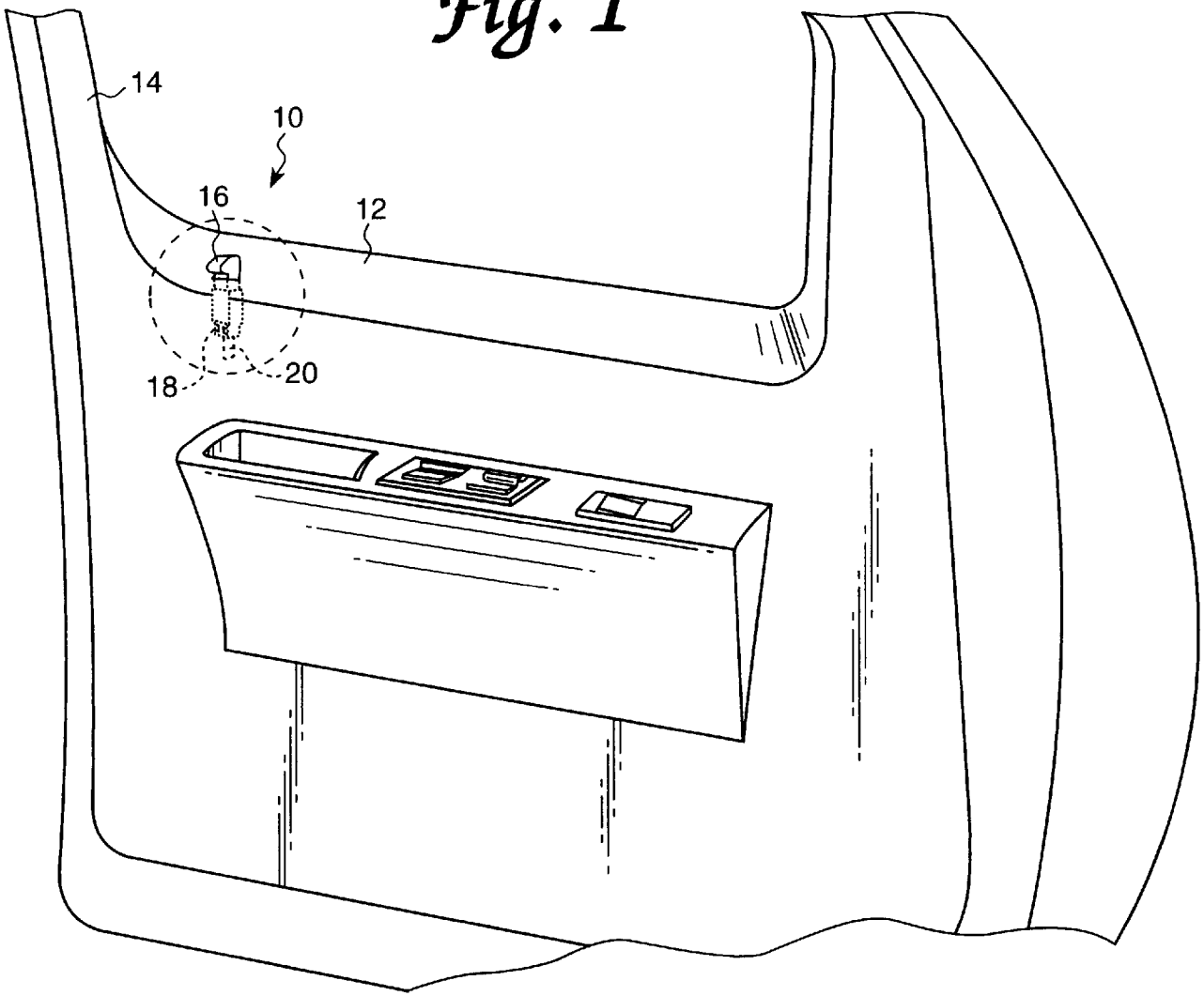
FIG. 1 is a perspective view of a conventional automobile door with a lock button clip assembly constructed in accordance with the principles of the present invention shown positioned therein.

FIG. 1 shows a lock button clip assembly, generally indicated at 10, housed within a panel 12 of a conventional automobile door 14 and embodying the principles of the present invention. The lock button clip assembly 10 comprises a molded plastic lock button, generally indicated at 16, and an exterior structure in the form of a stamped metal clip member 18. The lock button 16 and the clip member 18 work in conjunction with an actuating member in the form of a metal lock rod 20 in order to actuate a locking mechanism (not shown) used with the automobile door 14.

Figure 2:
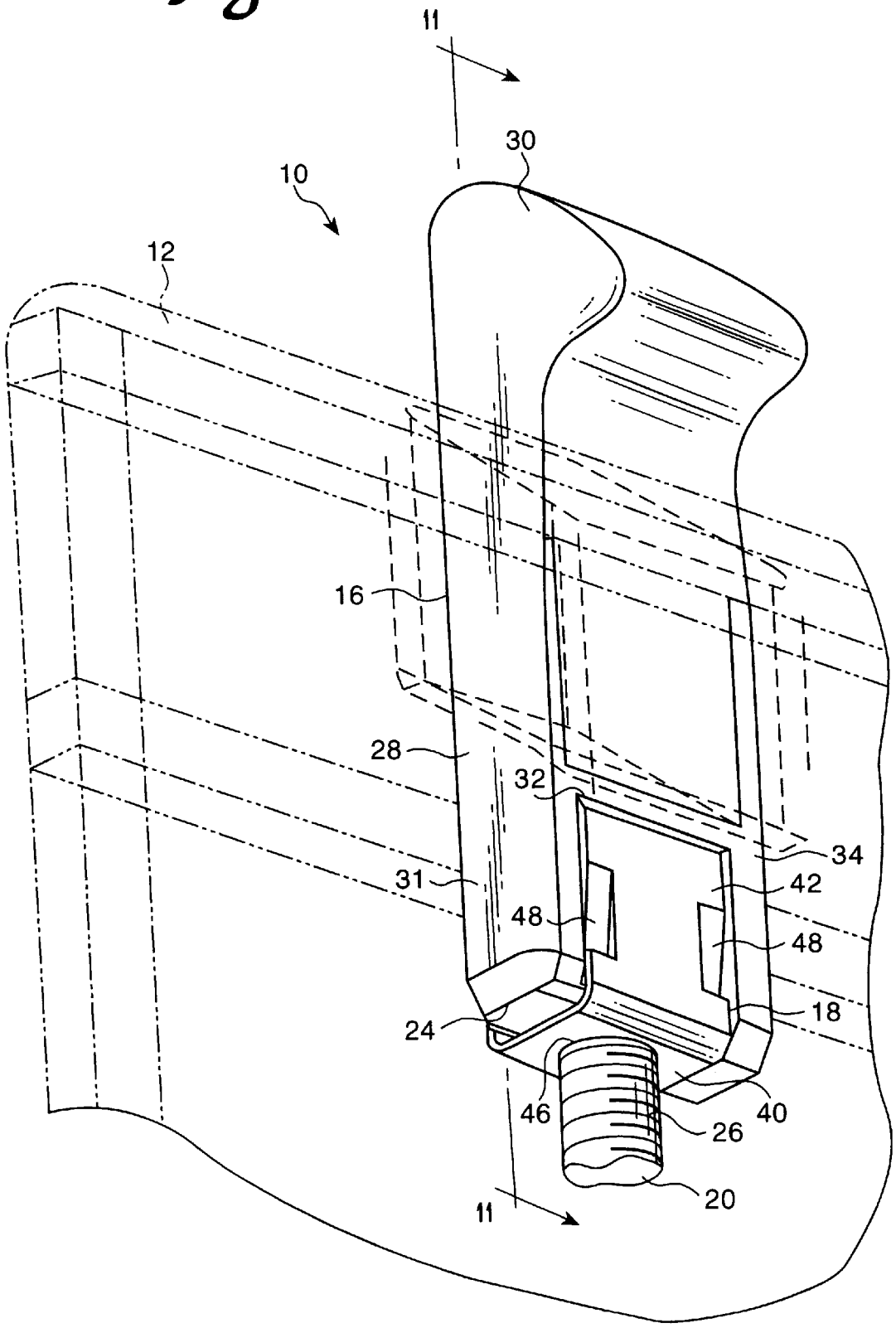
FIG. 2 is a perspective view of the lock button clip assembly housed within the paneling of a conventional automobile door.
Figure 3:
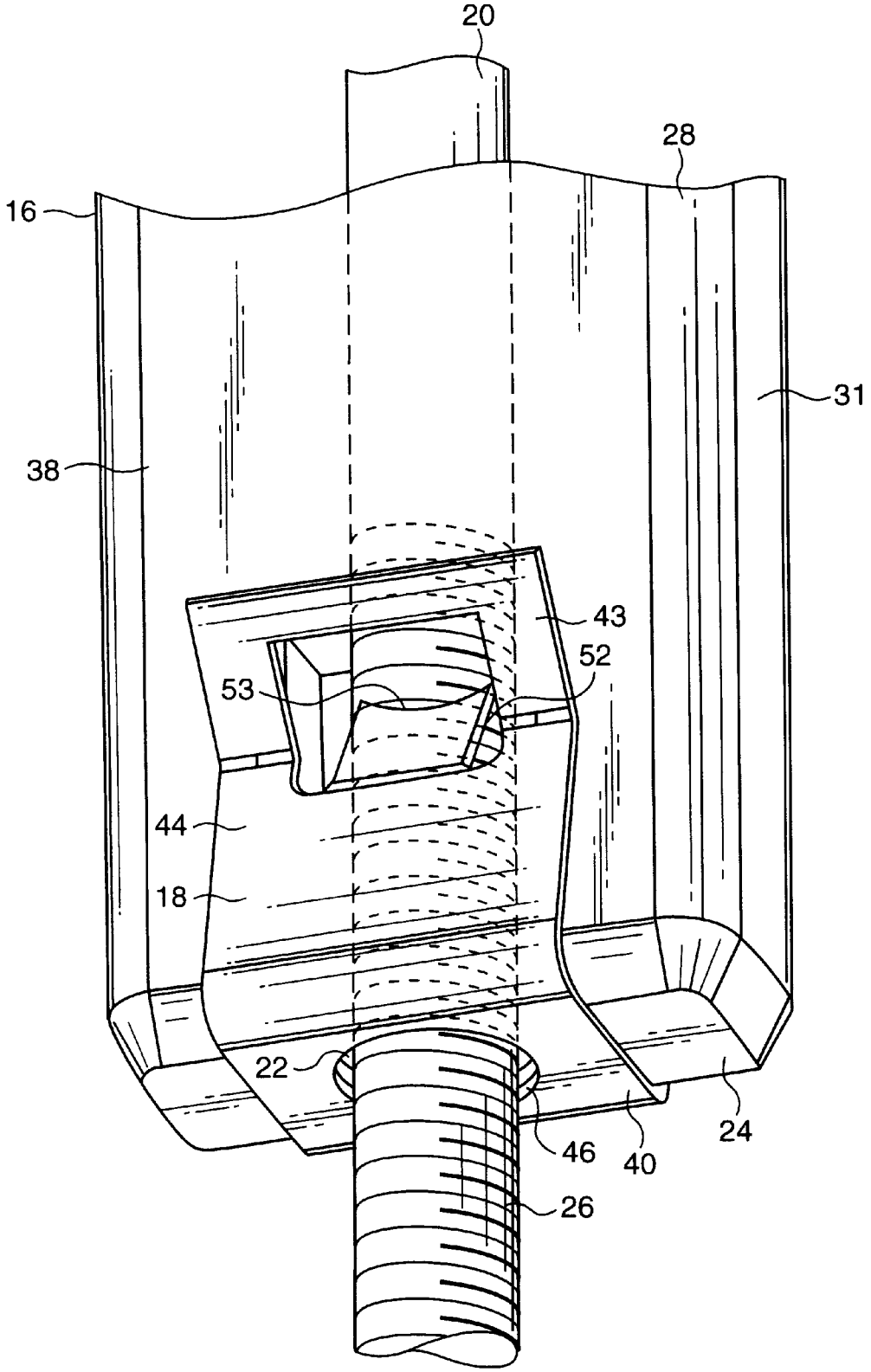
FIG. 3 is a perspective view of the outboard lower side of the lock button clip assembly.

It can be seen in FIGS. 2 and 3 that the lock button 16 is substantially rectangular in shape, and has a cylindrical bore 22 formed longitudinally into the lock button 16 through a bottom end 24 and a substantially flat and parallel body portion 28. An arcuately protruding top end 30 forms a hook-like section for ease of gripping.

Figure 5:
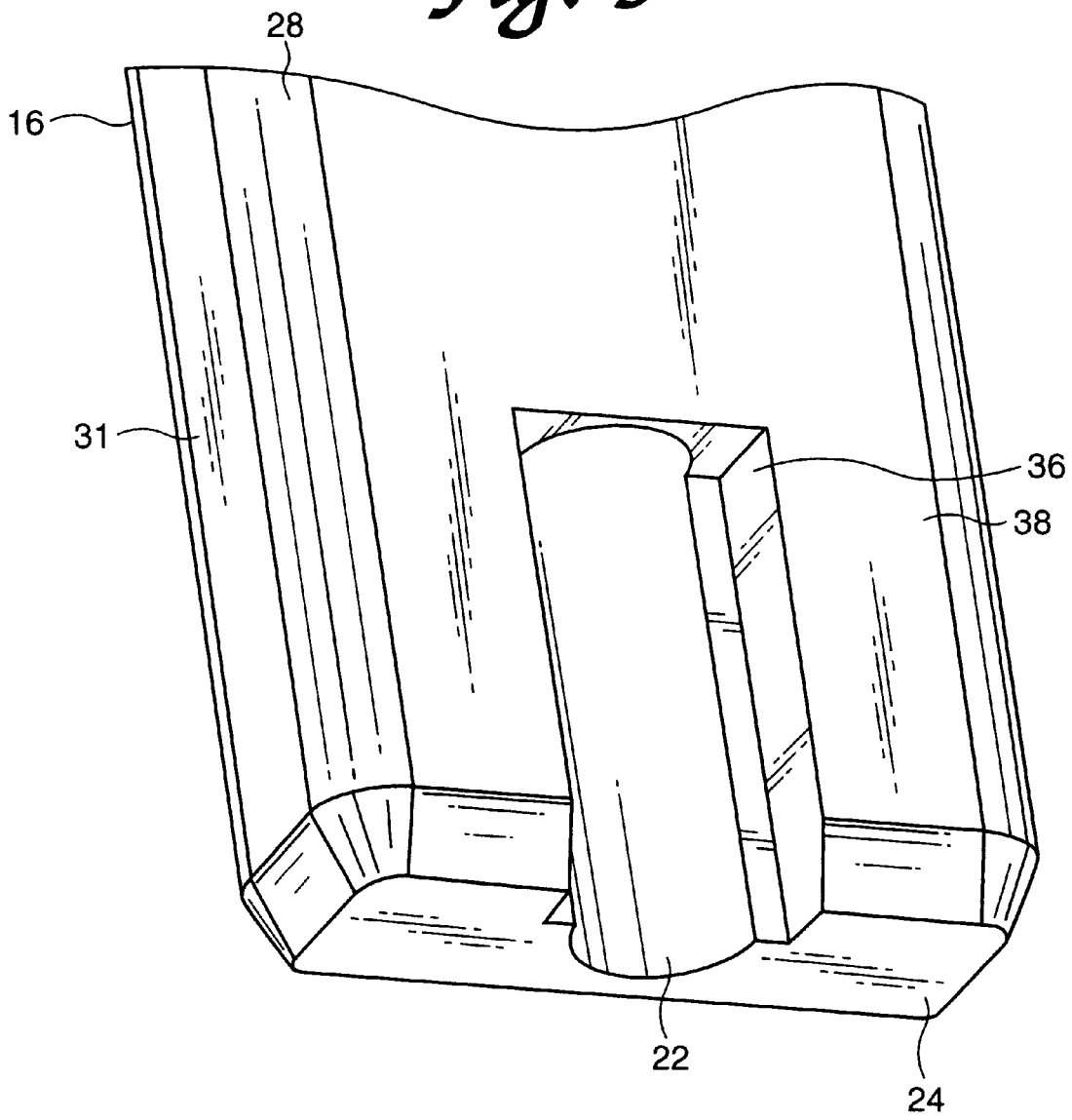
FIG. 5 is a perspective view of the lower outboard side of the lock button without the clip member installed.

The lower section 31 of the body portion 28 of the lock button 16 includes an essentially square recessed portion 32 inwardly formed on the inboard face 34, as shown in FIG. 2. An outwardly facing opening in the form of an essentially oblong slot 36 is formed on the outboard face 38 of the lower section, as shown in FIG. 5. The recessed portion 32, and slot 36 are formed as attachment areas for the clip member 18.

As best shown in FIG. 3, the lock rod 20 is a cylindrical shaft having threads 26 and extending from a locking mechanism upwardly into a cylindrical bore 22 of the lock button 16. The door locking mechanism is of the type used conventionally in the industry and is known to those familiar with the art. Therefore, the locking mechanism will not be shown or described herein.

Figure 4:
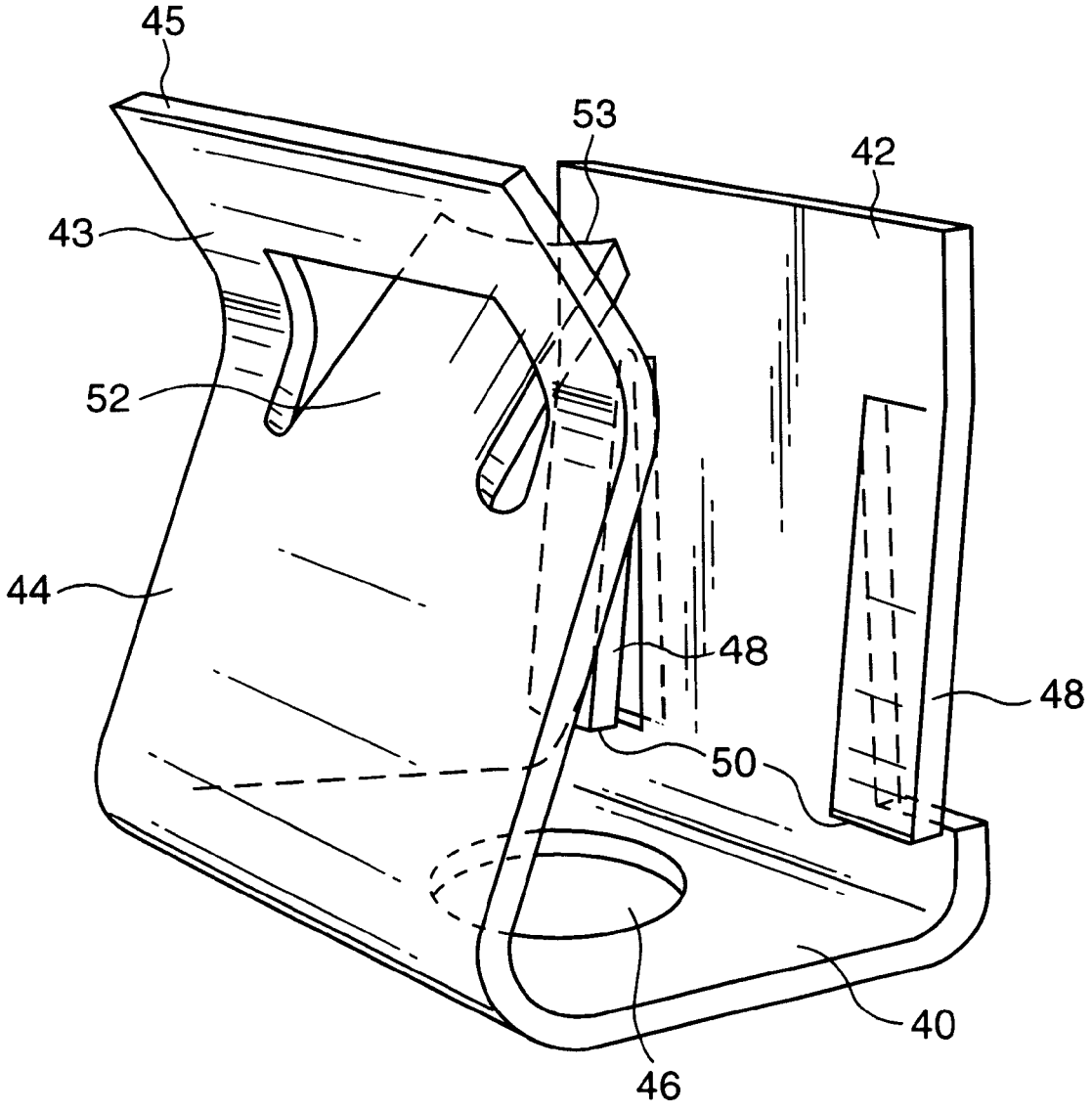
FIG. 4 is a perspective view of the clip member removed from the lock button.

As shown in FIG. 4, the clip member 18 is substantially U-shaped, constructed of a suitable material, preferably metal, and is biased inwardly to lock into the lower section 31 of the lock button 16. The clip member 18 comprises a base portion 40 with opposing side walls in the form of an inboard wall portion 42 and an outboard wall portion 44 extending upwardly therefrom. The base portion 40 is sized to allow the bottom end 24 of the lock button 16 to fit snugly therein and has a centrally located circular aperture 46 that aligns with the longitudinal cylindrical bore 22 in the bottom end 24 of the lock button 16 to allow the lock rod 20 to pass therethrough.

The inboard wall 42 of the clip member 18 extends upwardly from the base portion 40 10 and has a slight inward bias. Oblong shaped locking tabs 48 are stamped into the inboard wall 42 and project inwardly such that the tab ends 50 fully extend into the recess 32 formed in the inboard face 34 of the lock button 16 when the lock button 16 is mounted in the clip member 18.

The outboard wall 44 of the clip member 18 extends upwardly from the base portion 40 and angles inwardly. The release projection 43 of the wall 44 bends arcuately outward and continues to the top end 45 thereof. Tab stop 52 is stamped from wall 44. A top portion of the tab stop 52 is pressed or biased inwardly. An inwardly extending projection in the form of a tab stop 52 has a concave end 53 for engaging the lock rod 20 when inserted into the lock button clip assembly 10. The arcuate release projection 43 of the outboard wall 44 and the angled outer face of the tab stop 52 form a substantially V-notched section that provides for ease of removal of the lock button clip assembly 10 as described herein.

As can be seen in FIG. 5, the oblong slot 36 on the outboard face 38 of the lock button 16 has a depth that extends approximately half-way through the cylindrical bore 22. The slot 36 is wide enough to receive the lock tab 52 of the clip member 18. The lock rod 20 extends through the cylindrical bore 22 and is engaged therein by the lock tab 52 of the clip member 18.

Figure 6:
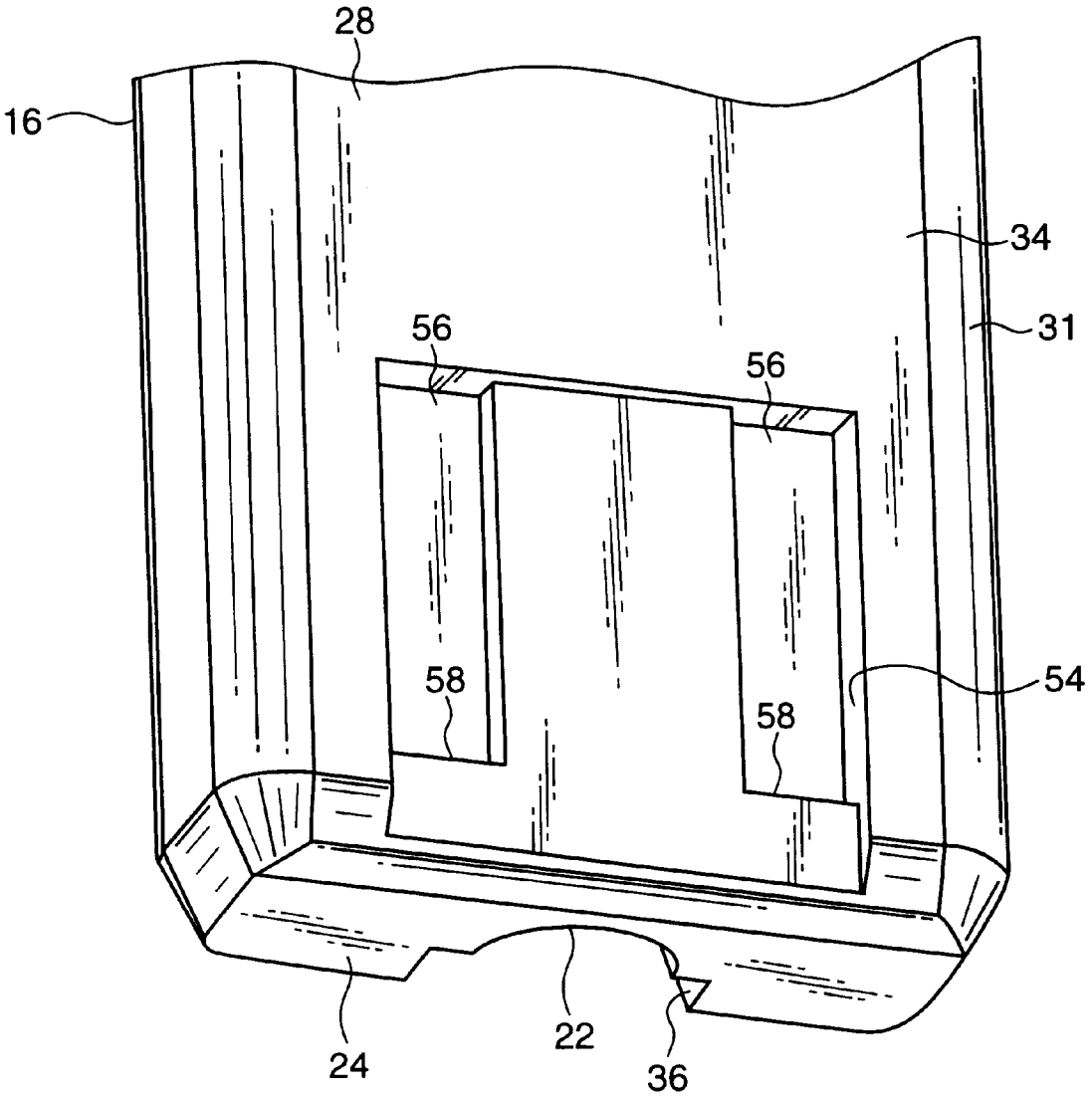
FIG. 6 is a perspective view of the lower inboard side of the lock button without the clip member installed.

As can be appreciated from FIG. 6, the lower section 31 of the inboard face 34 of the lock button 16 has an inwardly formed recess 54 sized to receive the inboard wall 42 of the clip member 18, thereby establishing a substantially flush surface when the clip member 18 is installed onto the lock button 16. The recess 54 has two longitudinal slots 56 along the sides thereof to provide a locking receptacle. More specifically, the two longitudinal slots 56 are recessed further into the inboard face 34 of the lock button 16. The slots 56 form a snap-fit connection with the locking tabs 48 of the clip member 18. The lower inside edges 58 of the longitudinal slots 56 provide upwardly facing surface which cooperate with downwardly facing surfaces provided on the ends 50 of the locking tabs 48 to engage and lock the clip member 18 onto the lock button 16.

Referring to FIGS. 2 and 3, the clip member 18 is pushed upwardly over the bottom 24 of the lock button 16. The inboard wall 42 of the clip member 18 is received into the recess 32 in the inboard face 34 of the lock button 16. The locking tabs 48 then snap into the receiving slots 36 and lock the clip member 18 onto the lock button 16. The lock button clip assembly 10 is then pushed downwardly onto the lock rod 20. The lock rod 20 slides longitudinally into the cylindrical bore 22 engaging and pushing the tab stop 52 outward, thereby allowing the lock rod 20 to be fully inserted within the cylindrical bore 22 of the lock button clip assembly 10. Once installed, the arcuate end 53 of the tab stop 52 engages undersides the threads 26 of the lock rod 20, thereby locking the assembly 10 onto the lock rod 20. It can be understood that the lock button 16 is used in a conventional manner to lock and unlock the automobile door 14.

As can be seen in FIGS. 9A, 9B, 10A, and 10B, the lock button 16 can be molded using a number of manufacturing methods and materials. Preferably, the recess 54 for the locking tab stops 48 of the clip member 18 and the bore 22 for the rod 20 can be provided separately. The recess 54 can be cut horizontally through the central portion of the lock button 16. The bore 22 for the rod 20 can be formed by drilling through the bottom 24 of the lock button 16.

Figure 10A:
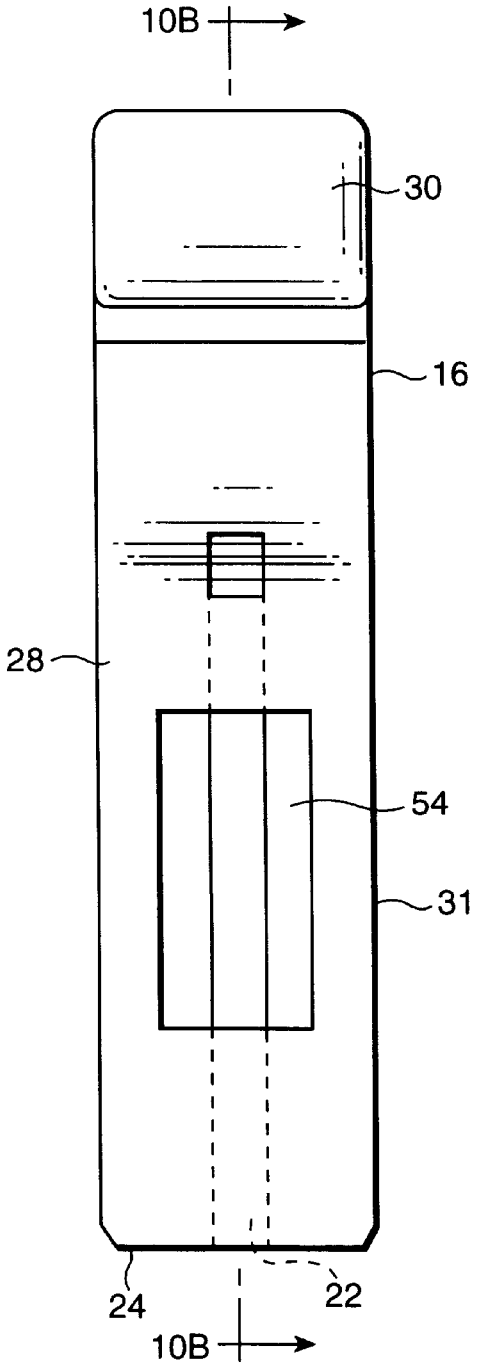
FIG. 10A is a front plan view of a lock button similar to that of FIG. 9A showing the internal bores formed using an alternate manufacturing method.
Figure 10B:
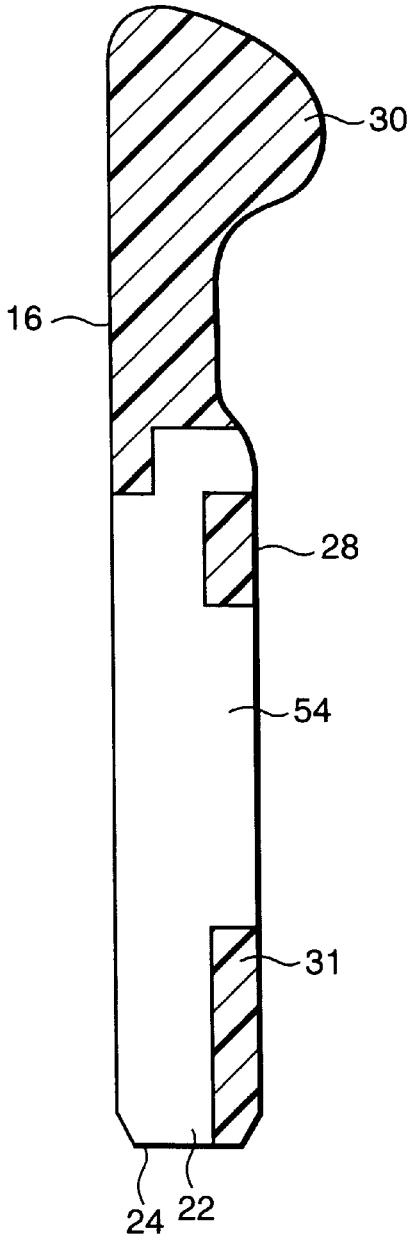
FIG. 10B is a longitudinal sectional view of a lock button along lines 10B—10B of FIG. 10A showing the internal bores formed by another manufacturing method without using a camming operation.

As seen in FIGS. 10A and 10B, the lock button 16 can be cut through horizontally, thus forming the passage as required for the clip member 18 and rod 20. This is accomplished by cutting horizontally into the inboard face 34 and the outboard face 38 of the lock button 16 to form the cylindrical bore 22 for the rod 20.

Figure 11:
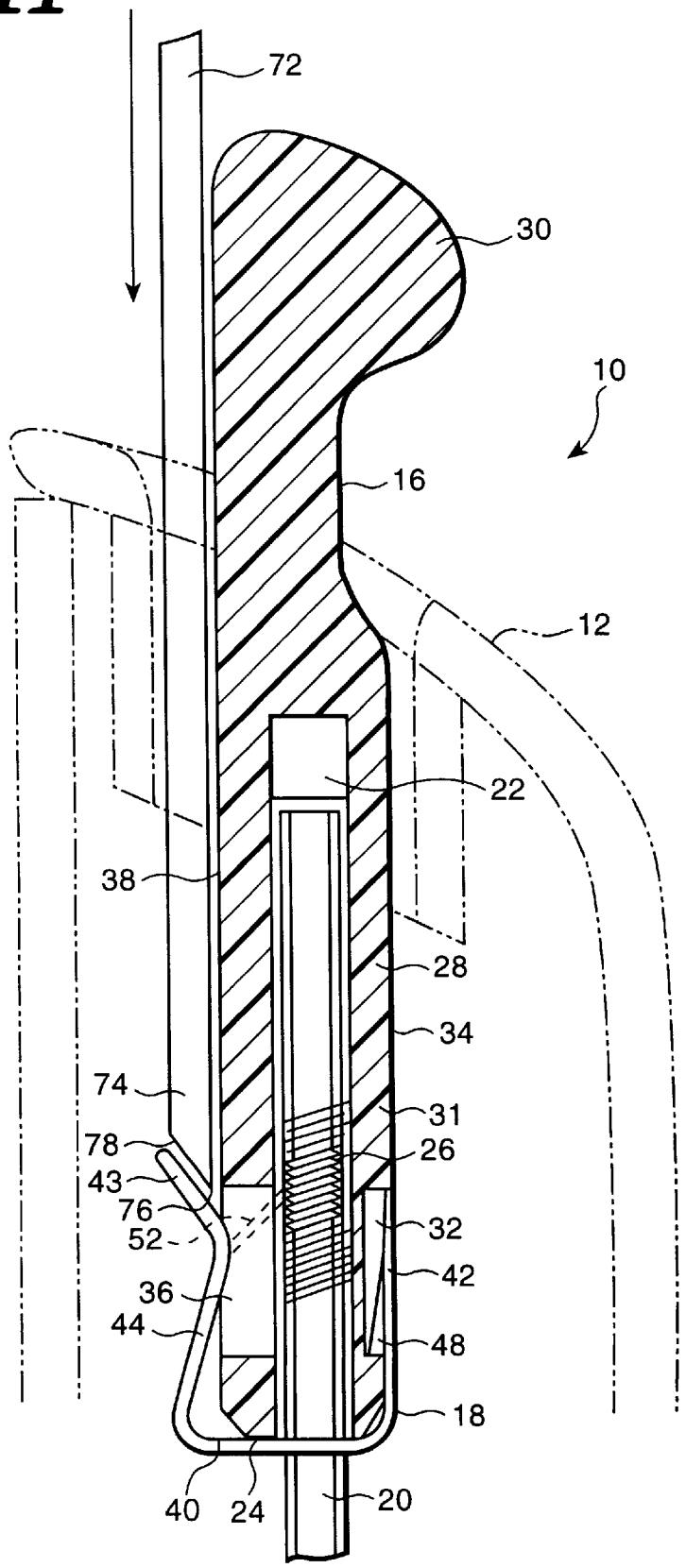
FIG. 11 is a longitudinal sectional view of the lock button clip assembly along lines 11—11 of FIG. 2, housed within a conventional automobile door, and showing the release tool positioned therein.
Figure 12:
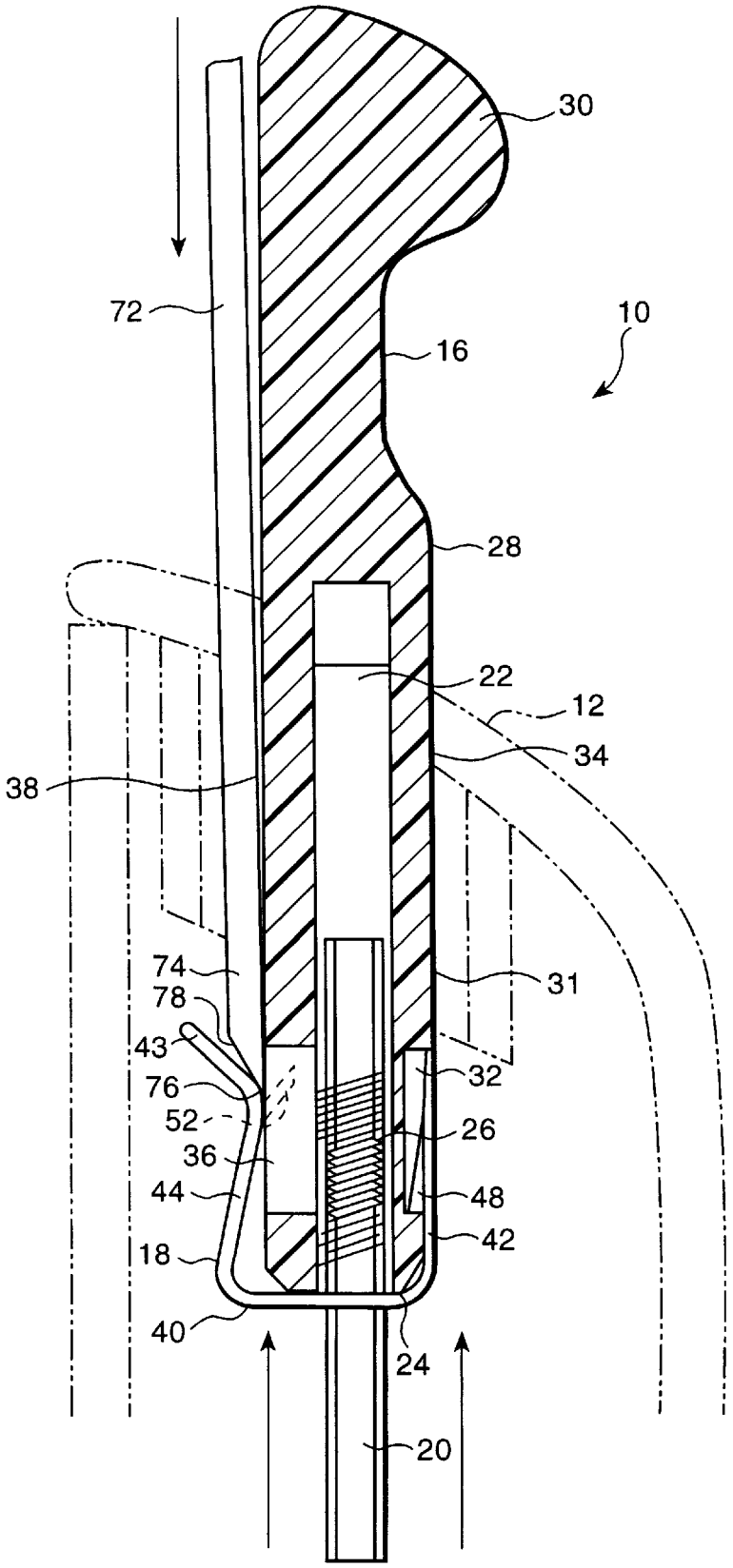
FIG. 12 is a longitudinal sectional view of the lock button clip assembly showing the release tool engaging the clip member, and the lock button clip assembly being removed from the door housing.

As can be seen in FIG. 11, the lock button clip assembly 10, can be positioned at given points on the lock rod 20. When initially installed, the lock button clip assembly 10 is simply pushed onto the rod 20 as previously described. In order to reposition the assembly 10 upwardly, or remove the assembly 10 entirely, a release tool 72 is inserted downwardly inside the automobile door 14 along the outboard face 38 of the lock button 16 to engage the release projection 43 of the outboard wall 44 of the clip member 18. The release tool 72 is tapered inwardly at a lower portion 74 thereof to form an angled engaging face 78 at its lowermost end 76. As can be understood from FIG. 12, upon engagement of the engaging face 78 with the arcuate release projection 43 of the clip member 18 outboard wall 44, the release tool 72 moves the release projection 43 outwardly away from the longitudinal slot 36 of the lock button 16, thereby disengaging the tab stop 52 from the lock rod 20. This allows the lock button clip assembly 10 to be repositioned along the lock rod 20 where desired or removed entirely from the door 14. Once the assembly 10 is in the desired position, the release tool 72 is removed, allowing the tab stop 52 to bias inwardly and reengage the lock rod 20, thus locking the lock button assembly 10 in place.

It can be appreciated that the present invention of the lock button clip assembly 10 offers several advantages over conventional lock buttons. Since it can be assembled after all other components and trim are in place, the lock button clip assembly 10 can be installed and removed without interference. Additionally, installation is accomplished by simply pushing the manual lock button clip assembly 10 down onto the lock rod 20, thereby obviating the need for the installer to perform repetitive twisting motions, and thus preventing the development of any related physical problems. Initial alignment is accomplished by simply pushing the lock button 16 down to the desired location. Another advantage is the ease of adjustment to various positions by using the thin release tool 72 to release the clip member 18, thereby affecting the repositioning or removal of the lock button clip assembly 10. Because of the simplicity of the lock button clip assembly 10, the cost of the producing the lock button assembly 10 according to the present invention is lower in relation to existing lock buttons.

Figure 7:
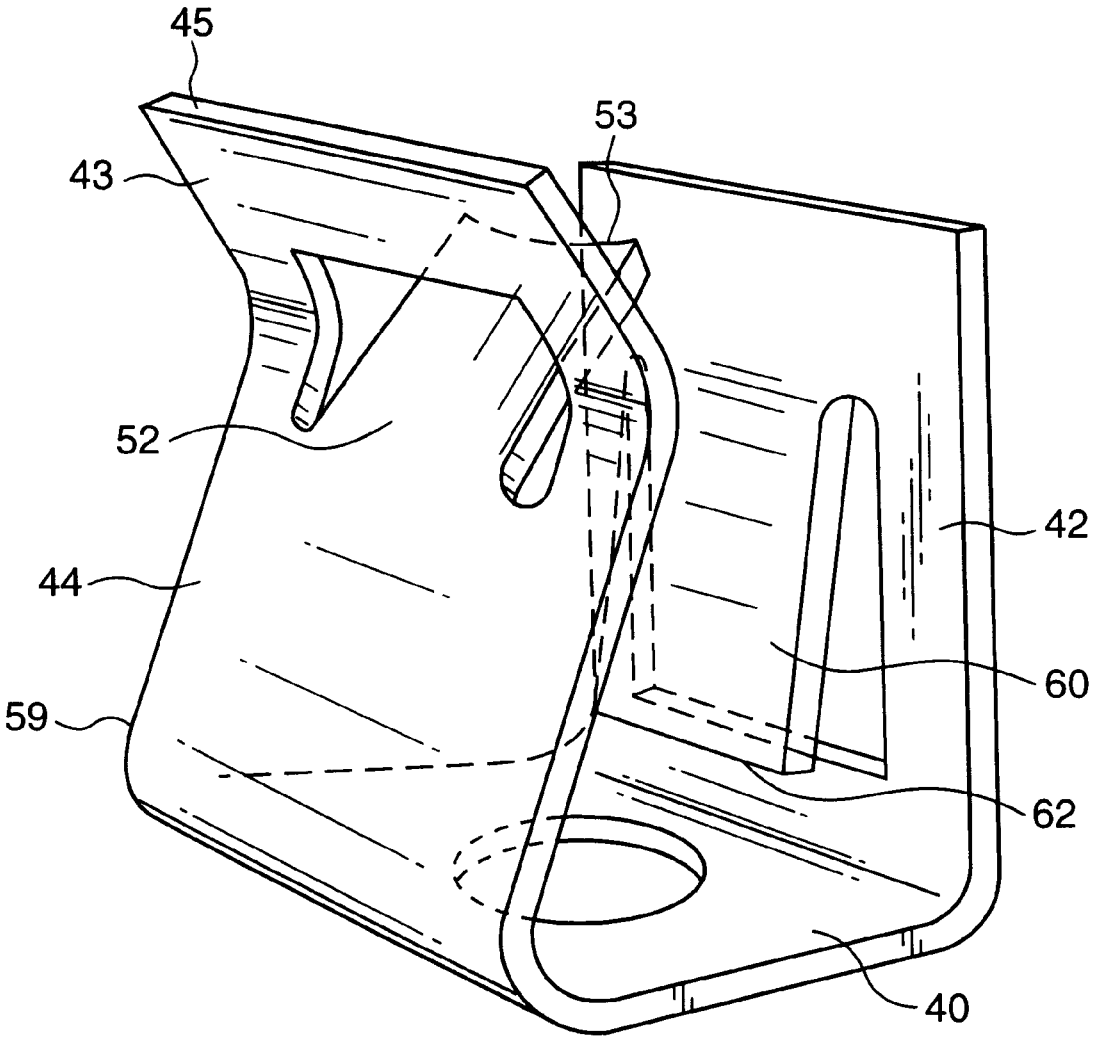
FIG. 7 is a perspective view of a second embodiment of the lower inboard side of the lock button.

FIG. 7 shows a second embodiment of a clip member 59 having a base portion 40 and an outboard wall 44 configuration substantially the same as clip member 18. When it is applicable, structures and components in the second embodiment which correspond to structures and components in the first embodiment will be referenced with the same numerals. The inboard wall 42 of the clip member 59 extends upwardly from the base portion 40 is biased slightly inward. A centrally located, rectangularly shaped locking tab 60 is stamped into the inboard wall 42 and projects inwardly. The tab end 62 fits into a formed recess 64 on the inboard face 34 of a lock button 65 shown in FIG. 8.

Figure 8:
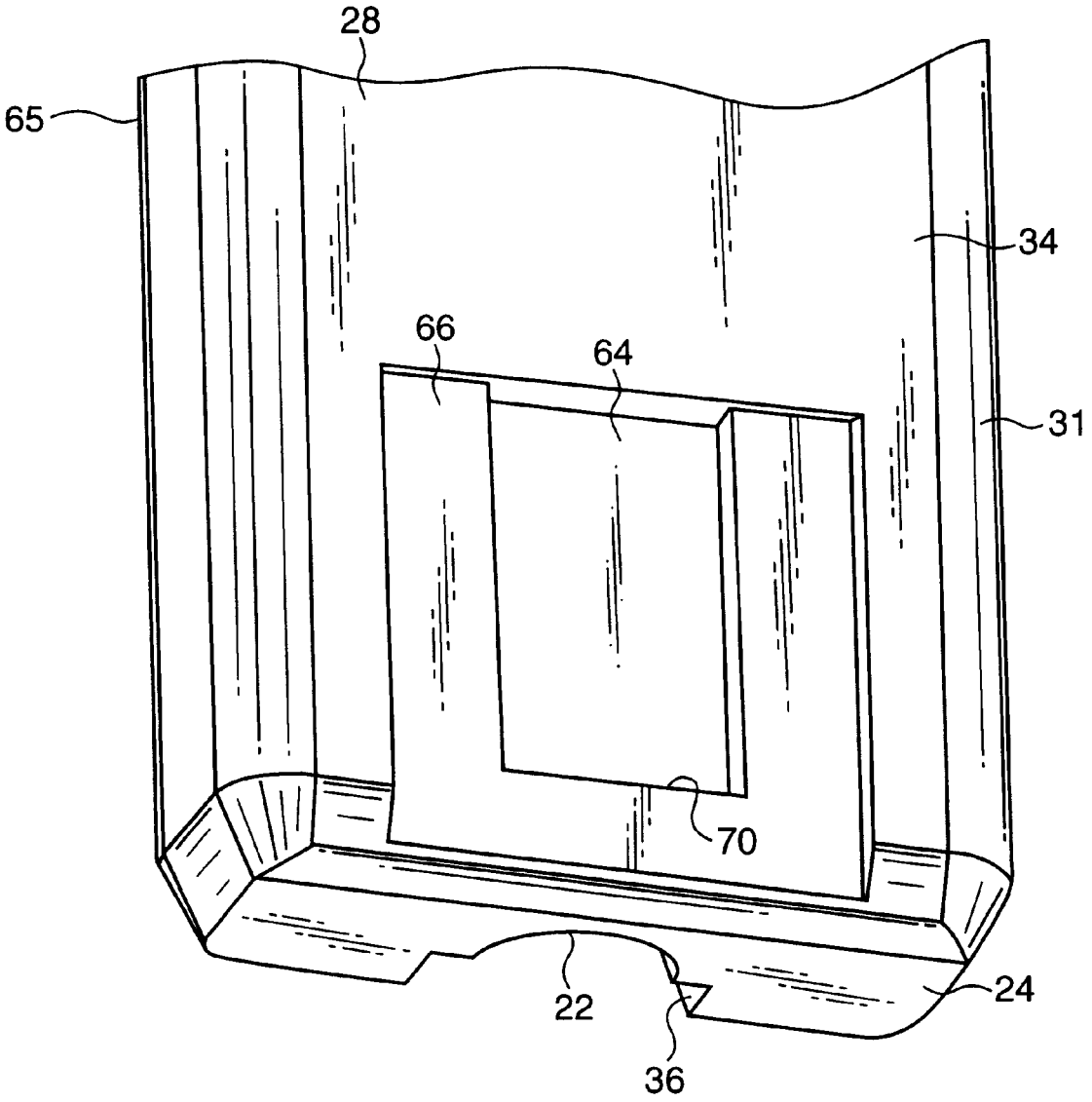
FIG. 8 is a perspective view of the second embodiment of the clip member.
Figure 9A:
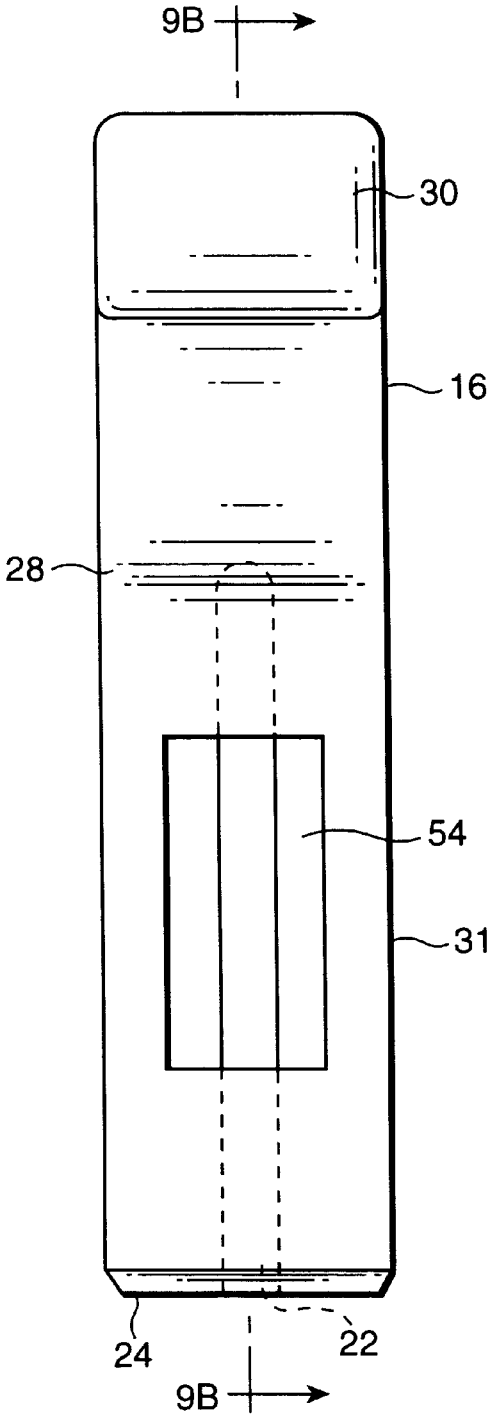
FIG. 9A is a front plan view of a lock button showing the internal bores formed during manufacturing.
Figure 9B:
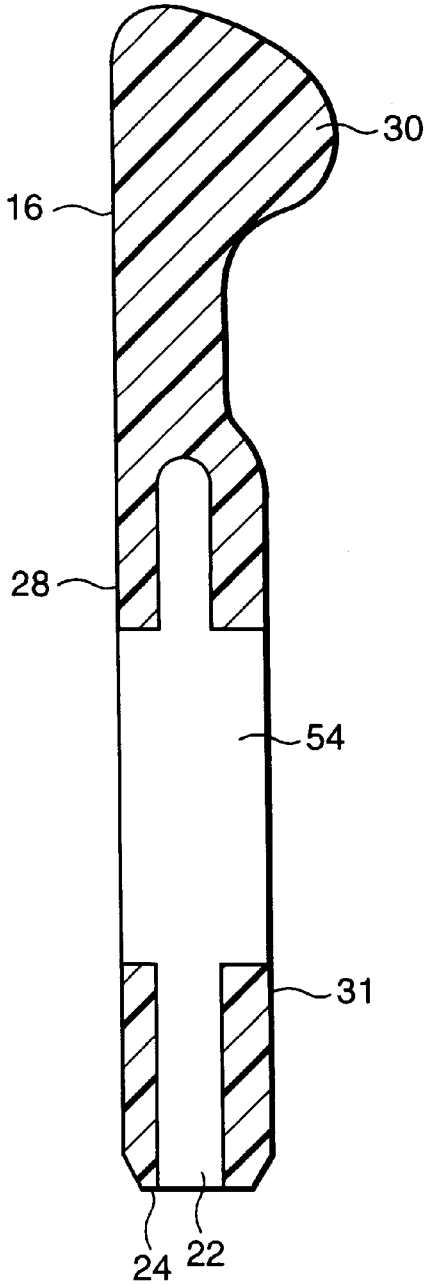
FIG. 9B is a longitudinal sectional view of a lock button along lines 9B—9B of FIG. 9A showing the internal bores formed by a manufacturing method using a camming operation.

As can be seen in FIG. 8, the second embodiment of the lock button 65 has a lower section 31 of an inboard face 34 with an inwardly formed recess 66 sized to allow the inboard wall 42 of the clip member 59 to fit therein. The inwardly formed recess 66 comprises a longitudinal central slot 68 that snap-fits with the rectangularly shaped lock tab 60 of the clip member 59. The lower inside edge 70 of the central slot 68 cooperates with the lock tab end 62 to engage and lock the clip member 59 onto the lock button 65. It can be appreciated that the lock button 65 and clip member 59 of the second embodiment are assembled in the same manner as the first embodiment.

It will thus be seen that the objects of this invention have been fully and effectively accomplished. It will be realized, however, that the foregoing preferred specific embodiments have been shown and described for the purpose of illustrating the functional and structural principles of this invention and is subject to change without departure from such principles. Therefore, this invention includes all modifications encompassed within the spirit and scope of the following claims.

What is claimed is:

1. A lock button assembly for installation on a threaded actuating member operatively connected to a vehicle door locking mechanism, said assembly comprising:

a manually engagable lock button having a longitudinally extending bore, said bore being adapted to receive a threaded end portion of the actuating member;

said lock button having an opening on one side thereof providing access to said bore;

a clip member mounted exteriorly to said lock button, said clip member having a resilient projection extending inwardly through said opening and into said bore; said projection being adapted to permit ingress of said actuating member into said bore and to frictionally engage said threaded portion to prevent egress of said actuating member from said bore.

2. A lock button assembly according to claim 1, wherein said clip member has opposing side walls mounted exteriorly of said lock button, said projection being formed integrally with one of said side walls.

3. A lock button assembly according to claim 2, wherein said one of said side wall has a release projection extending opposite said projection, said release projection being adapted for movement out of engagement with the upper end portion threads, thereby enabling said lock button assembly to be freely moved along the actuating member.

4. A lock button assembly according to claim 3, wherein said clip member comprises a base portion interconnecting said side walls, said base portion having an opening formed therethrough and aligned with the bore of said lock button.

5. A lock button assembly according to claim 4, wherein a second said side wall of said clip member frictionally engages said lock button to secure said clip member thereon.

6. A lock button assembly according to claim 5, wherein said clip member has a locking tab and said lock button has an aperture receiving said locking tab; said locking tab biased to permit application of said clip member onto said lock button and to prevent removal of said clip member from said lock button.

7. A lock button assembly according to claim 5, wherein said clip member has a pair of locking tabs and said lock button has a pair of apertures receiving said locking tabs, each of said locking tab biased to permit application of said clip member onto said lock button and to prevent removal of said clip member from said lock button.

8. A lock button assembly according to claim 5 wherein said button is made from molded plastic.

9. A lock button assembly according to claim 8, wherein said clip member is metal.

10. A method for installing a lock button assembly on a threaded actuating member operatively connected to a vehicle door locking mechanism, said method comprising:

providing a lock button assembly comprising:

a manually engagable lock button having a longitudinally extending bore, said bore being configured to receive a threaded end portion of the actuating member; said lock button having an opening on one side thereof providing access to said bore;

a clip member mounted exteriorly to said lock button, said clip member having a resilient projection extending inwardly through said opening and into said bore to frictionally engage with said threaded portion; said projection biased to permit ingress of said actuating member into said bore and to prevent egress of said actuating member from said bore;

initially positioning said lock button assembly on the actuating member with the end portion received in said bore; and thereafter moving said assembly along the actuating member until said assembly reaches an installed position.

11. A method according to claim 10, wherein said clip member has opposing side walls mounted exteriorly of said lock button and said one of said side walls has said projection and a release projection extending opposite said projection, said method further comprising the steps of:

providing a tool to move said release projection out of engagement with the upper end portion threads, thereby enabling said lock button assembly to be freely moved along the actuating member.

* * * * *